US008814507B1

(12) United States Patent
Campbell et al.

(10) Patent No.: US 8,814,507 B1
(45) Date of Patent: Aug. 26, 2014

(54) COOLING SYSTEM FOR THREE HOOK RING SEGMENT

(71) Applicants: Christian X Campbell, Charlotte, NC (US); Darryl Eng, Stuart, FL (US); Ching-Pang Lee, Cincinnati, OH (US); Harry Patat, Hobe Sound, FL (US)

(72) Inventors: Christian X Campbell, Charlotte, NC (US); Darryl Eng, Stuart, FL (US); Ching-Pang Lee, Cincinnati, OH (US); Harry Patat, Hobe Sound, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 13/903,087

(22) Filed: May 28, 2013

(51) Int. Cl.
*F01D 25/12* (2006.01)

(52) U.S. Cl.
CPC ..... *F01D 25/12* (2013.01)
USPC ..... 415/173.1; 415/213.1; 415/139

(58) Field of Classification Search
CPC ..... F01D 11/08; F01D 11/12; F01D 11/14; F01D 25/12; F05D 2240/11
USPC ..... 415/173.1, 173.4, 174.4, 213.1, 139
See application file for complete search history.

(56) References Cited

U.S. PATENT DOCUMENTS

| | | | | |
|---|---|---|---|---|
| 4,573,865 | A | 3/1986 | Hsia et al. | |
| 4,679,981 | A | 7/1987 | Guibert et al. | |
| 5,056,988 | A * | 10/1991 | Corsmeier et al. | 415/173.2 |
| 5,127,793 | A | 7/1992 | Walker et al. | |
| 6,126,389 | A | 10/2000 | Burdgick | |
| 6,340,285 | B1 | 1/2002 | Gonyou et al. | |
| 6,779,597 | B2 | 8/2004 | DeMarche et al. | |
| 7,097,418 | B2 | 8/2006 | Trindade et al. | |
| 7,270,175 | B2 | 9/2007 | Mayer et al. | |
| 7,665,962 | B1 | 2/2010 | Liang | |
| 7,670,108 | B2 | 3/2010 | Liang | |
| 7,722,315 | B2 | 5/2010 | Lee et al. | |
| 7,740,442 | B2 | 6/2010 | Lee et al. | |
| 7,740,444 | B2 | 6/2010 | Lee et al. | |
| 7,785,067 | B2 | 8/2010 | Lee et al. | |
| 7,997,856 | B2 | 8/2011 | Khanin et al. | |
| 8,147,192 | B2 * | 4/2012 | Jones et al. | 415/173.1 |
| 8,246,298 | B2 * | 8/2012 | Wilson | 415/116 |
| 8,353,663 | B2 | 1/2013 | Arzel et al. | |
| 2003/0131980 | A1 | 7/2003 | DeMarche et al. | |
| 2003/0133790 | A1 | 7/2003 | Darkins, Jr. et al. | |
| 2011/0171013 | A1 | 7/2011 | Arzel et al. | |

FOREIGN PATENT DOCUMENTS

| | | | |
|---|---|---|---|
| EP | 1124039 | A1 | 8/2001 |
| EP | 1500789 | A1 | 1/2005 |
| EP | 1676981 | A2 | 7/2006 |

* cited by examiner

*Primary Examiner* — Ninh H Nguyen

(57) ABSTRACT

A triple hook ring segment including forward, midsection and aft mounting hooks for engagement with respective hangers formed on a ring segment carrier for supporting a ring segment panel, and defining a forward high pressure chamber and an aft low pressure chamber on opposing sides of the midsection mounting hook. An isolation plate is provided on the aft side of the midsection mounting hook to form an isolation chamber between the aft low pressure chamber and the ring segment panel. High pressure air is supplied to the forward chamber and flows to the isolation chamber through crossover passages in the midsection hook. The isolation chamber provides convection cooling air to an aft portion of the ring segment panel and enables a reduction of air pressure in the aft low pressure chamber to reduce leakage flow of cooling air from the ring segment.

19 Claims, 7 Drawing Sheets

COOLING SYSTEM FOR THREE HOOK RING SEGMENT

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The present invention relates to ring segments for gas turbine engines and, more particularly, to cooling of ring segments in gas turbine engines.

BACKGROUND OF THE INVENTION

A gas turbine engine generally includes a compressor section, a combustor section, a turbine section and an exhaust section. In operation, the compressor section may induct ambient air and compress it. The compressed air from the compressor section enters one or more combustors in the combustor section. The compressed air is mixed with the fuel in the combustors, and the air-fuel mixture can be burned in the combustors to form a hot working gas. The hot working gas is routed to the turbine section where it is expanded through alternating rows of stationary airfoils and rotating airfoils and used to generate power that can drive a rotor. The expanded gas exiting the turbine section may then be exhausted from the engine via the exhaust section.

It is known that the maximum power output of a combustion turbine is achieved by heating the gas flowing through the combustion section to as high a temperature as is feasible. The hot gas, however, heats the various turbine components, such as airfoils and ring segments, which it passes when flowing through the turbine section. One aspect limiting the ability to increase the combustion firing temperature is the ability of the turbine components to withstand increased temperatures. Consequently, various cooling methods have been developed to cool turbine hot parts.

In the case of ring segments, ring segments typically include a cavity supplied with high pressure air which passes through an impingement plate to provide impingement cooling to a ring segment panel. Longer ring segments may be provided with a middle support hook located between forward and aft support hooks, dividing the high pressure cavity into two cavities, one on each side of the middle support hook. The high pressure air can be provided to each of the two chambers to cool the panel, such as is disclosed in U.S. Pat. No. 8,353,663.

SUMMARY OF THE INVENTION

In accordance with an aspect of the present invention, a turbine shroud assembly is provided for a gas turbine engine. The turbine shroud assembly comprises a ring segment including a ring segment panel comprising a leading edge, a trailing edge and a midsection defined therebetween, the ring segment comprising a forward mounting hook at the leading edge, a midsection mounting hook at the midsection and an aft mounting hook at the trailing edge. A ring segment carrier is provided circumferentially spanning and supporting the ring segment. The ring segment carrier comprises a forward section, a midsection and an aft section. The forward section forms a forward hanger coupled to the forward mounting hook. The midsection forms a midsection hanger coupled to the midsection mounting hook and defines a first leakage path. The aft section forms an aft hanger coupled to the aft mounting hook and defines a second leakage path. A forward impingement cooling chamber is defined between the ring segment panel and the ring segment carrier and between the forward mounting hook and the midsection mounting hook. At least one feed hole extends through the ring segment carrier and is configured to meter high pressure cooling air into the forward impingement cooling chamber. An aft low pressure chamber is defined between the ring segment panel and the ring segment carrier and between the midsection hanger and the aft mounting hook. The ring segment carrier substantially prevents cooling air from entering the aft low pressure chamber. An isolation plate extends between the midsection mounting hook and an aft location adjacent to the ring segment panel defining an isolation chamber radially inward from the aft low pressure chamber between the isolation plate and the ring segment panel. A transverse crossover passage is formed through the midsection mounting hook providing cooling air from the forward impingement cooling chamber to the isolation chamber, the isolation plate substantially preventing cooling air provided to the isolation chamber from entering the aft low pressure chamber.

A forward impingement cooling plate may extend between the midsection mounting hook and a forward location in the forward impingement cooling chamber, the forward impingement cooling plate including impingement cooling holes and separating the forward impingement cooling chamber into a radially outer cooling chamber supply side and a radially inner impingement cooling side. Cooling air within the supply side of the forward impingement cooling chamber may pass through the first leakage path to the low pressure aft chamber, and cooling air within the low pressure aft chamber may pass out of the turbine shroud assembly through the second leakage path.

Cooling air provided to the isolation chamber may be directed into contact with the ring segment panel providing convective cooling to the ring segment panel from a location adjacent the midsection mounting hook to a location adjacent the aft mounting hook.

The isolation plate may be sealed to the ring segment panel along axially extending sides of the ring segment panel between the midsection mounting hook and the aft mounting hook.

The transverse crossover passage may be located radially inward from a junction of the isolation plate with the midsection mounting hook for effecting transfer of cooling air from the forward impingement cooling chamber to the isolation chamber.

An aft impingement cooling plate may be located radially inward from the transverse crossover passage between the isolation plate and the ring segment panel extending between the midsection mounting hook and an aft location adjacent to the panel. The aft impingement cooling plate may include impingement cooling holes providing impingement cooling from the isolation chamber to at least a portion of an outwardly facing surface of the panel. A forward impingement cooling plate may extend between the midsection mounting hook and a forward location in the forward impingement cooling chamber, and the forward and aft impingement cooling plates may comprise primary zone cooling plates providing impingement cooling to primary zones of the panel, and further including forward and aft secondary impingement cooling plates providing impingement cooling to secondary zones of the panel, wherein respective forward and aft primary and secondary cooling plates form two-step serial cooling paths extending forward and aft of the midsection mounting hook.

A plurality of axial flow convection cooling channels may be formed in an outer side of the ring segment panel having inlet ends adjacent to the midsection hanger hook, and the inlet ends may receive cooling air from the isolation chamber.

One or more axial convective cooling passages may extend within the ring segment panel adjacent to axial edges of the panel, each of the axial convective cooling passages including an inlet receiving cooling air from the aft low pressure chamber.

A plurality of convective cooling passages may be provided in the panel extending from the forward impingement cooling chamber to the axial edges of the panel, the convective cooling passages located between the midsection mounting hook and the leading edge of the panel.

The forward, midsection and aft sections of the ring segment carrier may include respective forward, midsection and aft support structure engaged with cooperating structure of a casing for the engine. A forward high pressure plenum may be defined between the forward and midsection support structures for providing the high pressure cooling air through the at least one feed hole, and an aft low pressure plenum may be defined between the midsection and the aft support structures and may be substantially isolated from the high pressure cooling air of the forward high pressure plenum.

In accordance with another aspect of the invention, a turbine shroud assembly may be provided for a gas turbine engine. The turbine shroud assembly comprises a ring segment including a ring segment panel comprising a leading edge, a trailing edge and a midsection defined therebetween, the ring segment comprising a forward mounting hook at the leading edge, a midsection mounting hook at the midsection and an aft mounting hook at the trailing edge. A ring segment carrier is provided circumferentially spanning and supporting the ring segment. The ring segment carrier comprising a forward section, a midsection and an aft section. The forward section forms a forward hanger coupled to the forward mounting hook. The midsection forms a midsection hanger coupled to the midsection mounting hook and defines a first leakage path. The aft section forms an aft hanger coupled to the aft mounting hook and defines a second leakage path. The forward section of the ring segment carrier includes a forward support structure engaged with a forward cooperating structure of a casing of the engine. The midsection of the ring segment carrier includes a midsection support structure engaged with a midsection cooperating structure of the casing. The aft section of the ring segment carrier includes an aft support structure engaged with an aft cooperating structure of the casing. A forward high pressure plenum is defined between the forward support structure and the midsection support structure for providing high pressure cooling air to a forward impingement cooling chamber defined between the ring segment panel and the ring segment carrier and between the forward mounting hook and the midsection mounting hook. An aft low pressure plenum is defined between the midsection support structure and the aft support structure and is substantially isolated from the high pressure cooling air of the forward high pressure plenum. An aft low pressure chamber is defined between the ring segment panel and the ring segment carrier and between the midsection hanger and the aft mounting hook. An isolation chamber is defined radially inward from the aft low pressure chamber between the midsection mounting hook and the aft mounting hook. A transverse crossover passage connects the forward impingement cooling chamber to the isolation chamber. The isolation chamber substantially isolates the aft low pressure chamber from cooling air provided through the transverse crossover passage to effect a reduction of leakage air through the second leakage path.

A leakage of cooling air may pass from the forward impingement cooling chamber to the aft low pressure chamber through the first leakage path, and one or more flow passages may extend from the aft low pressure chamber to a location of lower pressure in fluid communication with a hot gas path through the engine for reducing the pressure in the aft low pressure plenum and further effecting a reduction of leakage air through the second leakage path.

The engagement between the aft support structure and the aft cooperating structure of the casing may define a third leakage path of cooling air out of the turbine shroud assembly, and the engagement between the midsection support structure and the midsection cooperating surface may define a fourth leakage path of cooling air from the forward high pressure plenum to the aft low pressure plenum.

Air entering the aft low pressure chamber comprises substantially only leakage air. Air within the aft low pressure chamber may comprise a cooling air source for convective cooling passages extending within the ring segment panel. The convective cooling passages may extend axially within the ring segment panel to the trailing edge of the ring segment panel.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

In accordance with aspects of the invention, an assembly in a gas turbine engine is provided including two-zone cooling of a three hook ring segment configured to reduce cooling air leakage. In particular, as a result of hot working gas flowing past the turbine blades, and a resulting extraction of work by the turbine blades, a large pressure drop can occur from a leading edge to a trailing edge of the ring segment. Hence, a cooling air pressure required by the ring segment to maintain a back flow margin can be different between the leading edge and the trailing edge, in that a pressure provided to maintain a required backflow margin at the leading edge could create excess leakage of cooling air at the trailing edge.

Aspects of the present invention particularly address leakage flows that occur at leakage paths formed at ring segment support locations of mid-sections and aft sections of the ring segments. In a specific configuration, a partition or isolation plate can be provided to isolate an aft mounting hook of the ring segment from high pressure air provided for cooling the ring segment, thereby reducing leakage air flow through a leakage path formed between the aft mounting hook and an aft hanger coupled to the aft mounting hook.

Additional aspects of the invention address variations in the thermal load along the axial length of the ring segment and at the circumferential mating edges of the ring segment. For example, the thermal load on the ring segment is greatest toward the leading edge of the ring segment and reduces toward the trailing edge of the ring segment. Also, impingement cooling may be available for central regions of the panel, while axially extending edges may require convective cooling passages. An initial use of the cooling air can be utilized to cool the hotter regions toward the leading edge of the ring segment, and the initially used cooling air can then be utilized for cooling regions of the ring segment toward the trailing edge, such as aft of the midsection mounting hook for supporting the ring segment.

Figure 1:
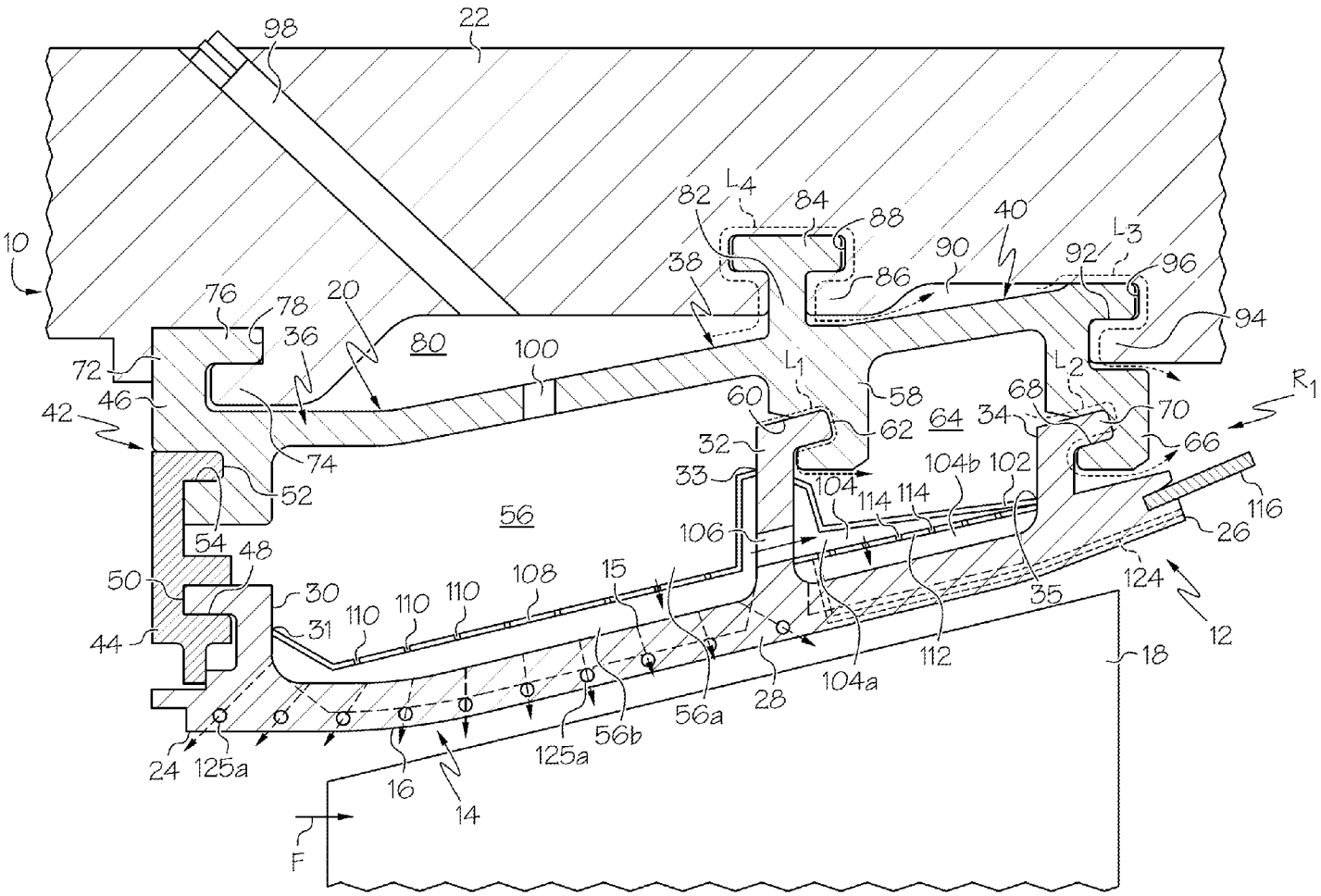
FIG. 1 is a cross sectional view of a turbine shroud assembly including a ring segment incorporating aspects of the present invention.

Referring to FIG. 1, a turbine shroud assembly is illustrated, generally indicated as 10, and includes a turbine ring segment 12 including a panel 14 having an inner side 16 in direct contact with a downstream flow of hot working gases F and subject to the high rotating speed from the tip of a turbine blade 18. As will be described in greater detail below, a plurality of the ring segments 12 are provided extending circumferentially within the engine around the blades 18, and the ring segments 12 are supported from a plurality of segmented ring segment carriers 20. Each ring segment carrier 20 spans circumferentially and is configured to support one or more ring segments 12. The ring segment carriers 20 are supported from an outer casing 22 of the engine, as is described further below.

Each ring segment panel 14 includes a leading edge 24, a trailing edge 26 and a midsection 28 defined therebetween. Additionally, the ring segment 12 comprises a forward mounting hook 30 at the leading edge 24, a midsection mounting hook 32 at the midsection 28 and an aft mounting hook 34 at the trailing edge 26.

Each ring segment carrier 20 includes a forward section 36, a midsection 38 and an aft section 40. The forward section 36 of the ring segment carrier 20 forms a forward hanger 42 coupled to the forward mounting hook 30. In particular, the forward section 36 may include a separate forward hanger member 44 extending from a main body 46 of the ring segment carrier 20, and the forward hanger member 44 defines a groove or slot 48 for receiving a flange section 50 of the forward mounting hook 30. The forward hanger member 44 is supported to the main body 46 by a hanger member flange 52 extending within a groove or slot 54 of the main body 46. The adjoining surfaces of the forward hook flange section 50 and the front hanger member slot 48, and the adjoining surfaces of the hanger member flange 52 and the main body slot 54, each form a seal for substantially limiting passage of cooling air in an upstream direction from a forward impingement cooling chamber 56. The forward impingement cooling chamber 56 is defined between the ring segment panel 14 and the ring segment carrier 20 and between the forward mounting hook 30 and the midsection mounting hook 32.

The midsection 38 of each ring segment carrier 20 forms a midsection hanger 58 coupled to the midsection mounting hook 32. In particular, the midsection hanger 58 defines a groove or slot 60 for receiving a flange section 62 of the midsection mounting hook 32. It may be noted that the adjoining surfaces of the midsection flange section 62 and the midsection hanger slot 60 form a seal for substantially limiting passage of cooling air from the forward chamber 56 to an aft low pressure chamber 64. The aft low pressure chamber 64 is defined between the ring segment panel 14 and the ring segment carrier 20 and between structure comprising the midsection mounting hook 32 and hanger 58 and the structure comprising the aft mounting hook 34 and an aft section hanger 66. Additionally, as will be described further below, the seal between the midsection mounting hook 32 and the midsection hanger 58 forms at least a portion of a first leakage location, or leakage path $L_1$, through which cooling air from the forward cooling chamber 56 may leak to the aft low pressure chamber 64.

The aft section hanger 66 is formed on the ring segment carrier 20 and is coupled to the aft mounting hook 34. In particular, the aft section hanger 66 defines a groove or slot 68 for receiving a flange section 70 of the aft mounting hook 34. It may be noted that the adjoining surfaces of the aft flange section 70 and the aft section hanger slot 68 form a seal for substantially limiting passage of cooling air in the downstream direction from the aft low pressure chamber 64. Additionally, as will be described further below, the seal between the aft mounting hook 34 and the aft hanger 66 forms at least a portion of a second leakage location, or leakage path $L_2$, through which cooling air may leak from the aft low pressure chamber 64.

The forward section 36 of each ring segment carrier 20 includes a support structure 72 engaged with a cooperating structure 74 of the engine casing 22. In particular, the support structure 72 comprises a flange section 76 engaged within a groove or slot 78 of the cooperating structure 74. It may be noted that the adjoining surfaces of the support structure flange section 76 and the cooperating structure slot 78 form a seal for substantially limiting passage of cooling air in the upstream direction from a forward high pressure plenum 80. The forward high pressure plenum 80 is defined between the ring carrier main body 46 and the casing 22 and between the cooperating structure 74 and a midsection support structure 82.

The midsection support structure 82 is formed at the midsection 38 of the ring segment carrier 20 and includes a flange section 84 engaged with a slot 88 of a cooperating structure 86 of the engine casing 22. It may be noted that the adjoining surfaces of the support structure flange section 84 and the cooperating structure slot 88 form a seal for substantially limiting passage of cooling air in the downstream direction from the forward high pressure plenum 80 toward an aft low pressure plenum 90. The aft low pressure plenum 90 is defined between the main body 46 of the ring segment carrier 20 and the casing 22 and between the midsection support structure 82 and an aft support structure 92.

The aft support structure 92 comprises an axially extending flange engaged and cooperating with an aft cooperating structure 94 defining a slot 96 receiving the aft support structure 92. It may be noted that the adjoining surfaces of the aft support structure 92 and the aft cooperating structure 94 form a seal for substantially limiting passage of cooling air in the downstream direction from the aft low pressure plenum 90.

Additionally, as will be described further below, the seal between the aft support structure 92 and the aft cooperating structure 94 forms at least a portion of a third leakage location, or leakage path $L_3$, through which cooling air may leak from the aft low pressure plenum 90, and the seal between the midsection support structure 82 and the midsection cooperating structure 86 forms at least a portion of a fourth leakage location, or leakage path $L_4$, through which cooling air may leak from the forward high pressure plenum 80 toward the aft low pressure plenum 90.

High pressure cooling air is supplied through the casing 22 to the forward high pressure plenum 80 through a supply passage 98 connected to a source or supply of cooling air, such as may be provided from the compressor section of the turbine engine. As noted above, a seal is formed between the midsection support structure 84 and the cooperating structure 86, such that the aft plenum 90 is substantially isolated from the high pressure air supplied to the forward plenum 80.

At least one feed hole 100 is formed through the main body 46 of the ring segment carrier 20 and is configured to meter high pressure cooling air from the forward plenum 80 into the forward impingement cooling chamber 56. The feed hole (or feed holes) 100 is preferably sized to provide the high pressure cooling air to the forward chamber 56 at substantially the same pressure as the air within the forward plenum 80, although losses may result in a slightly lower pressure within the forward chamber 56.

An isolation plate 102 extends between the midsection mounting hook 32 and an aft location adjacent to the ring segment panel 14, and defines an isolation chamber 104 radially inward from the aft low pressure chamber 64 between the isolation plate 102 and the panel 14. In particular, the isolation plate 102 may extend from a location on the midsection hook 32 adjacent to and radially inward from the area of the seal formed between the midsection hook 32 and the midsection hanger 58 to a location 35 on the aft mounting hook 34 adjacent to the panel 14.

A plurality of transverse crossover passages 106 extend through a radially inner end of the midsection mounting hook 32, providing fluid communication between the forward impingement cooling chamber 56 and the isolation chamber 104. A impingement cooling plate 108 is located within the forward chamber 56 adjacent to the ring segment panel 14, and extends from a location 33 radially outward from the crossover passages 106 on the midsection hook 32 to a forward location, illustrated in FIG. 1 as a location 31 on the forward mounting hook 30. The impingement cooling plate 108 divides the forward impingement cooling chamber 56 into a radially outer cooling chamber supply side 56*a* and a radially inner impingement cooling side 56*b*. A plurality of impingement cooling holes 110 are formed through the impingement cooling plate 108, permitting flow of the high pressure air from the supply side 56*a* to the cooling side 56*b* and providing impingement convection cooling to at least a portion of an outwardly facing surface 15 of the ring segment panel 14.

The cooling air within the cooling side 56*b* of the front chamber 56 is at a high pressure, and may be at a slightly lower pressure than the pressure within the supply side 56*a*, such as a pressure that is about 0.4 bar less than on the supply side 56*a*. The cooling air passes from the cooling side 56*b* through the crossover passages 106 to provide high pressure cooling air to the isolation chamber 104 where the pressure of the cooling air may be substantially similar to the pressure in the supply side 56*b*.

Figure 2:
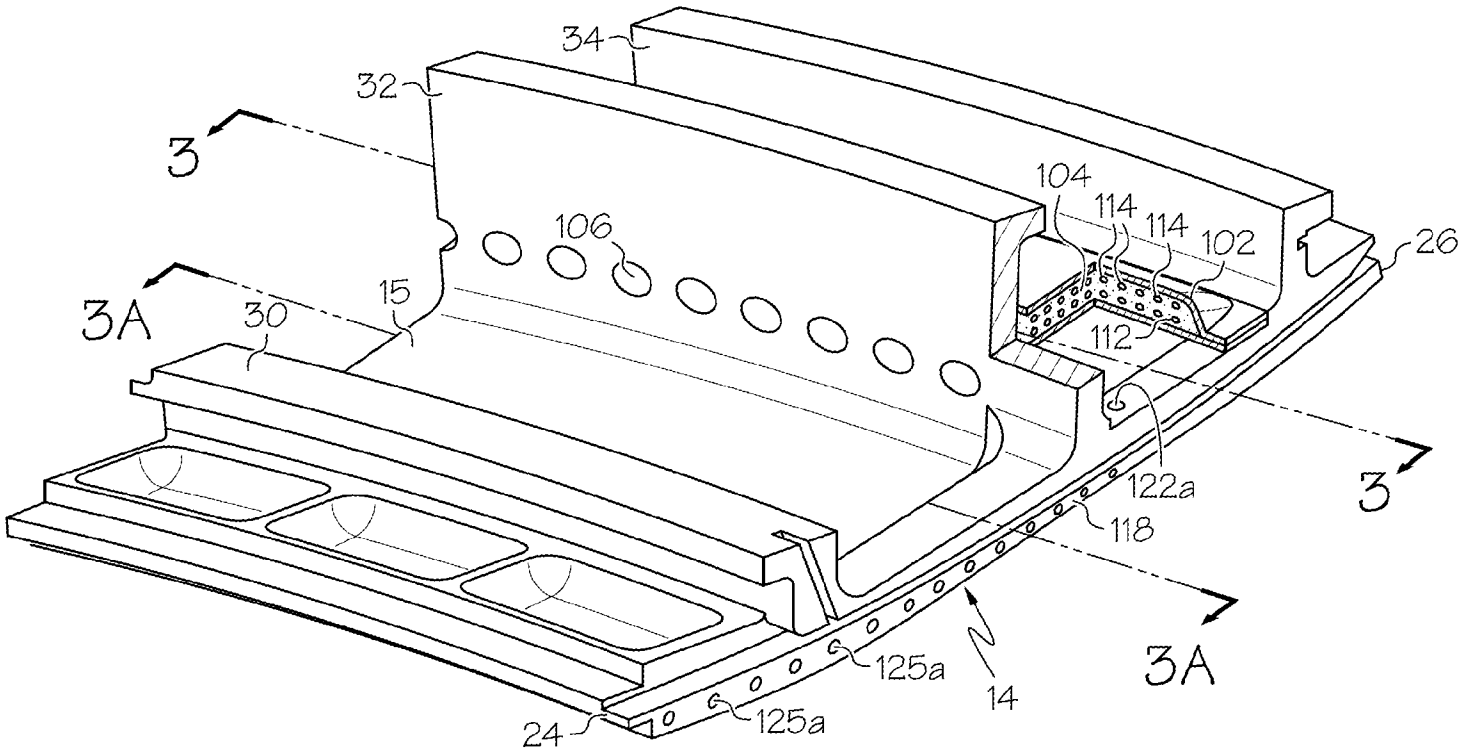
FIG. 2 is a partially cut away perspective view of a ring segment, shown without a forward impingement cooling plate, and illustrating aspects of the invention.
Figure 3:
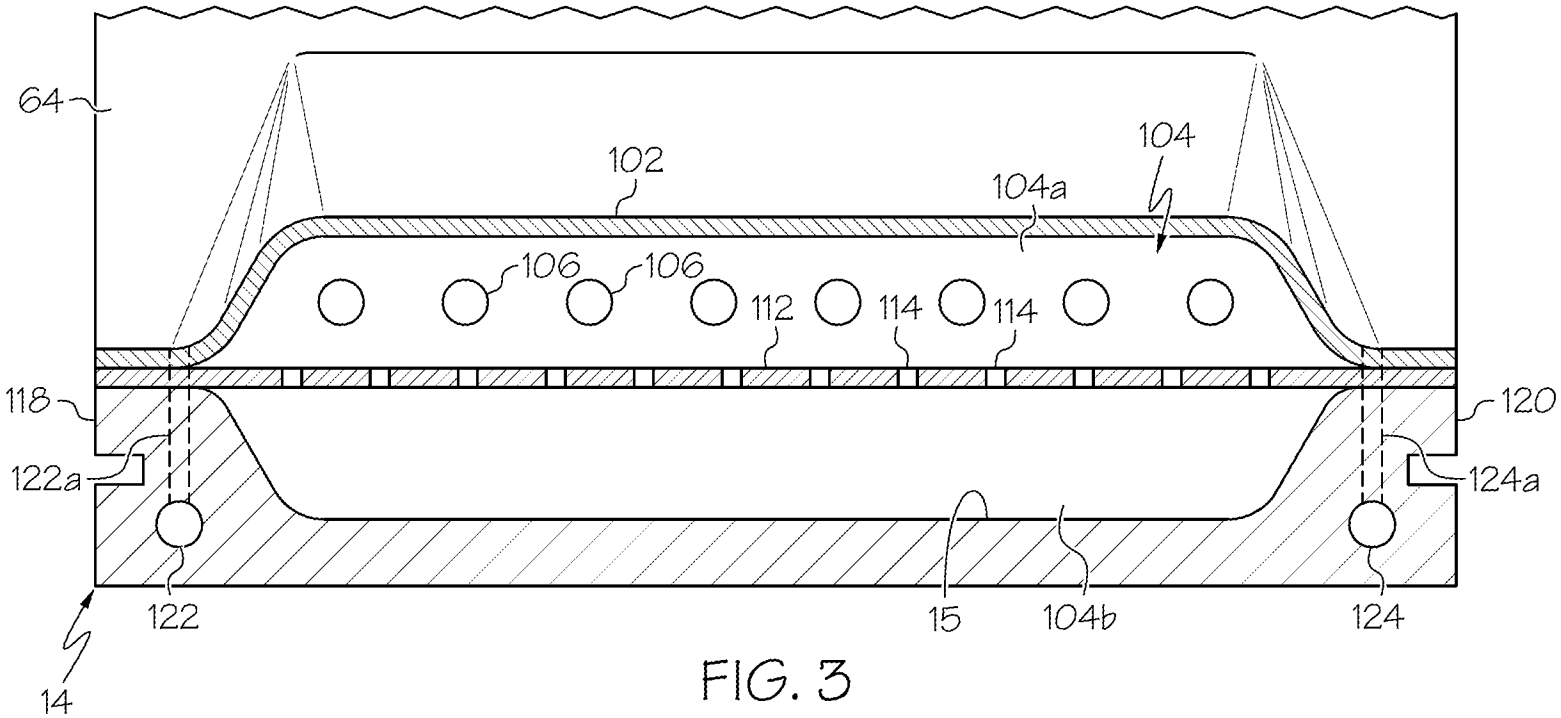
FIG. 3 is a cross sectional view taken along line 3-3 in FIG. 2.

Referring to FIGS. 1-3, an aft impingement cooling plate 112 is located radially inward from the crossover passage 106 between the isolation plate 102 and the ring segment panel 14 and extending between the midsection mounting hook 32 and an aft location adjacent to the panel 14, illustrated herein as having an aft location adjacent to the inner end of the aft mounting hook 34. The impingement cooling plate 112 divides the isolation chamber 104 into a radially outer supply side 104*a* and a radially inner impingement cooling side 104*b*. The aft impingement cooling plate 112 includes impingement cooling holes 114 permitting flow of high pressure cooling air from the isolation chamber supply side 104*a* to the impingement cooling side 104*b*, providing impingement convection cooling to at least a portion of the outwardly facing surface 15 of the panel 14.

The high pressure air within the turbine shroud assembly 10 is substantially contained within the forward plenum 80, the forward chamber 56 and the isolation chamber 104 to provide impingement cooling to portions of the ring segment panel 14 forward and aft of the midsection mounting hook 32. The aft plenum 90 and the aft chamber 64 receive leakage air along the fourth and first leakage paths $L_4$, $L_1$, respectively, and the cooling air within the aft chamber 64 is generally isolated from the cooling air within the aft plenum 90. A substantially lower pressure is maintained in the aft plenum 90 and the aft chamber 64 to minimize the leakage of cooling air out of the turbine shroud assembly 10 into the hot gas path through the third and second leakage paths $L_3$, $L_2$, respectively.

The location of the isolation plate 102 relative to the aft impingement cooling plate 112 is selected to provide a spacing between the plates 102, 112 for controlling flow through the holes 114. For example, a larger volume of the isolation chamber 104 than is shown herein may be provided, subject to assembly constraints and ensuring that the robustness of the connection between the isolation plate 102 and the aft mounting hook 34 at the location 35 is maintained.

It should be understood that there is a relatively large pressure difference in the hot gas path between the segment leading and trailing edges 24, 26, where the pressure drop from the leading edge 24 to the trailing edge 26 may be on the order of 6 bar. For example, the pressure within the hot gas path at the leading edge 24 may be about 19 bar and the pressure at the trailing edge may be about 13 bar, although it may be understood that references provided herein to pressures and pressure differences are presented for purposes of illustrating advantageous aspects of the present invention and are not limiting to the invention.

The pressure provided to the forward plenum 80 and the forward chamber 56 is sufficient to maintain a back flow margin to prevent back flow leakage at the forward connections formed at the locations of the support structure 72, the hanger member flange 52 and the flange section 50, and the pressure difference may be on the order of 2 to 3 bar relative to the pressure in the hot gas path.

The pressure resulting from leakage of air into the aft plenum 90 and the aft chamber 64 may be about 2 to 3 bar lower than the pressure in the respective forward plenum 80 and forward chamber 56. Further, the pressure at the aft side of the turbine shroud assembly 10, where the leakage paths $L_3$, $L_2$ exit, i.e., downstream of the aft mounting hook 34 and aft section hanger 66, may be at a higher pressure than the downstream gas path pressure, but lower than the pressure in the aft plenum 90 and the aft chamber 64, as a result of a seal structure 116 at the trailing edge 26 forming an isolated region $R_1$ downstream of the aft section hanger 66 and radially outward from the hot gas path. For example, the pressure in the region $R_1$ may be in a range of about 0.5 to 3 bar below the pressure in the aft plenum 90 and the aft chamber 64. Since the pressure of the hot gas at the trailing edge 26, as well as the pressure in the region $R_1$, is lower than at the leading edge 24, a pressure required to maintain an adequate back-flow margin within the turbine shroud assembly aft end is lower. By providing a lower pressure within the aft plenum 90 and the aft chamber 64, the pressure driving the leakage through the third and second leakage paths $L_3$, $L_2$ is reduced, resulting in a reduction in cooling air losses through leakage.

Hence, it should be apparent from the above that an aspect of the present invention provides a control over leakage from the ring segment cooling system through control of pressure within the plenums and chambers with reference to the surrounding pressures in the turbine hot gas path in order to reduce the relative driving pressures at the leakage path locations. As a result, the present configuration which isolates the majority of the outer area defined by the aft chamber 64 from high pressure air, effects an overall reduction in the cooling air requirements while efficiently maintaining adequate impingement cooling to the ring segment 12.

Referring to FIGS. 2 and 3, it can be seen that the isolation plate 102 and aft impingement cooling plate 112 are joined to the ring segment 12 along the radially outer side of the panel 14 adjacent to mating edges 118 and 120 (FIG. 3) of the panel 14, such that the isolation chamber 104 is configured as a sealed compartment between the midsection and aft mounting hooks 32, 34 and between the mating edges 118, 120. In addition, axial convection cooling passages 122, 124 may be formed extending axially through the ring segment panel 14 adjacent to the mating edges 118, 120 and include exit openings at the trailing edge 26 opening to the hot gas path. The axial passages 122, 124 include respective inlet passages 122*a*, 124*a* (FIG. 3) that open to the aft low pressure chamber 64. Since the hot gas path at the trailing edge 26 is at a lower pressure than the aft chamber 64, cooling air will flow from the aft chamber 64 to discharge into the hot gas path, lowering the pressure in the aft chamber 64 and providing convection cooling within the panel 14 adjacent to the mating edges 118, 120. The metering off of air into the axial passages 122, 124 and reduction of pressure within the aft plenum 64 reduces the amount of leakage air passing through the second leakage path $L_2$ while effecting an increase in cooling within the panel 14.

It should be noted that the inlet passages 124*a*, 124*b* (FIG. 3) may be connected to either of the sides 104*a*, 104*b* of the isolation chamber 104 to achieve higher cooling also allowing a higher leakage.

Figure 3A:
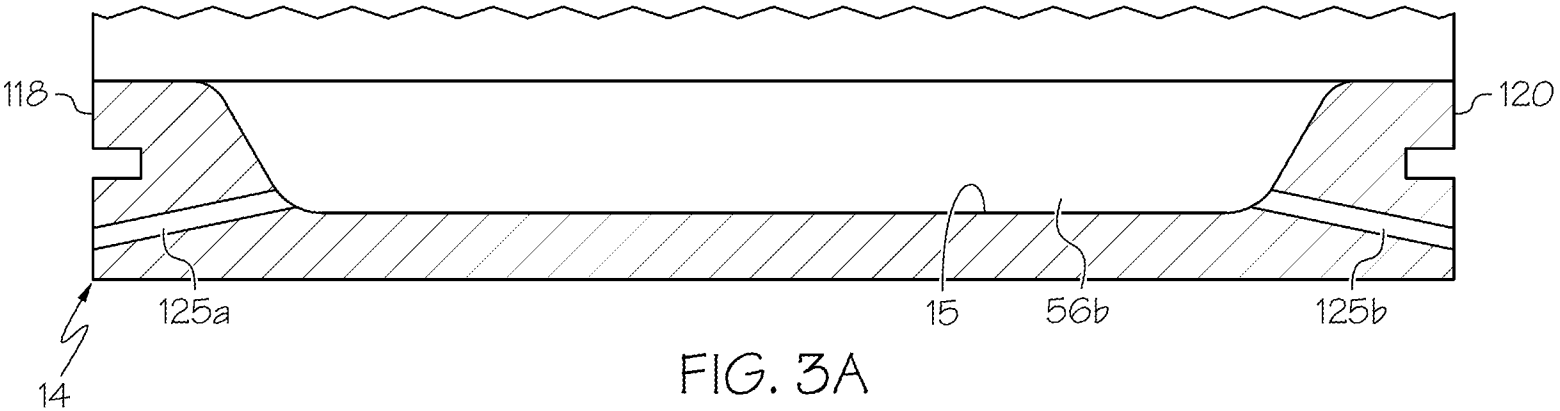
FIG. 3A is a cross sectional view taken along line 3A-3A in FIG. 2.

Additionally, cooling air may be provided to the mating edges 118, 120 along a forward portion of the panel 14. Specifically, as seen in FIGS. 1, 2 and 3A, a plurality of convection cooling passages 125*a*, 125*b* may be provided between a location adjacent to the midsection mounting hook 32 and the leading edge 24, and extending in the circumferential direction from the impingement cooling side 56*b* of the impingement cooling chamber 56 to the mating edges 118, 120. Cooling air passing through the convection cooling passages 125*a*, 125*b* provides convection cooling to the forward portions of the panel 14 between the impingement cooling chamber 56 and the mating edges 118, 120, and provides cooling air to the gaps between adjacent ring segments at the mating edges 118, 120.

Figure 4:
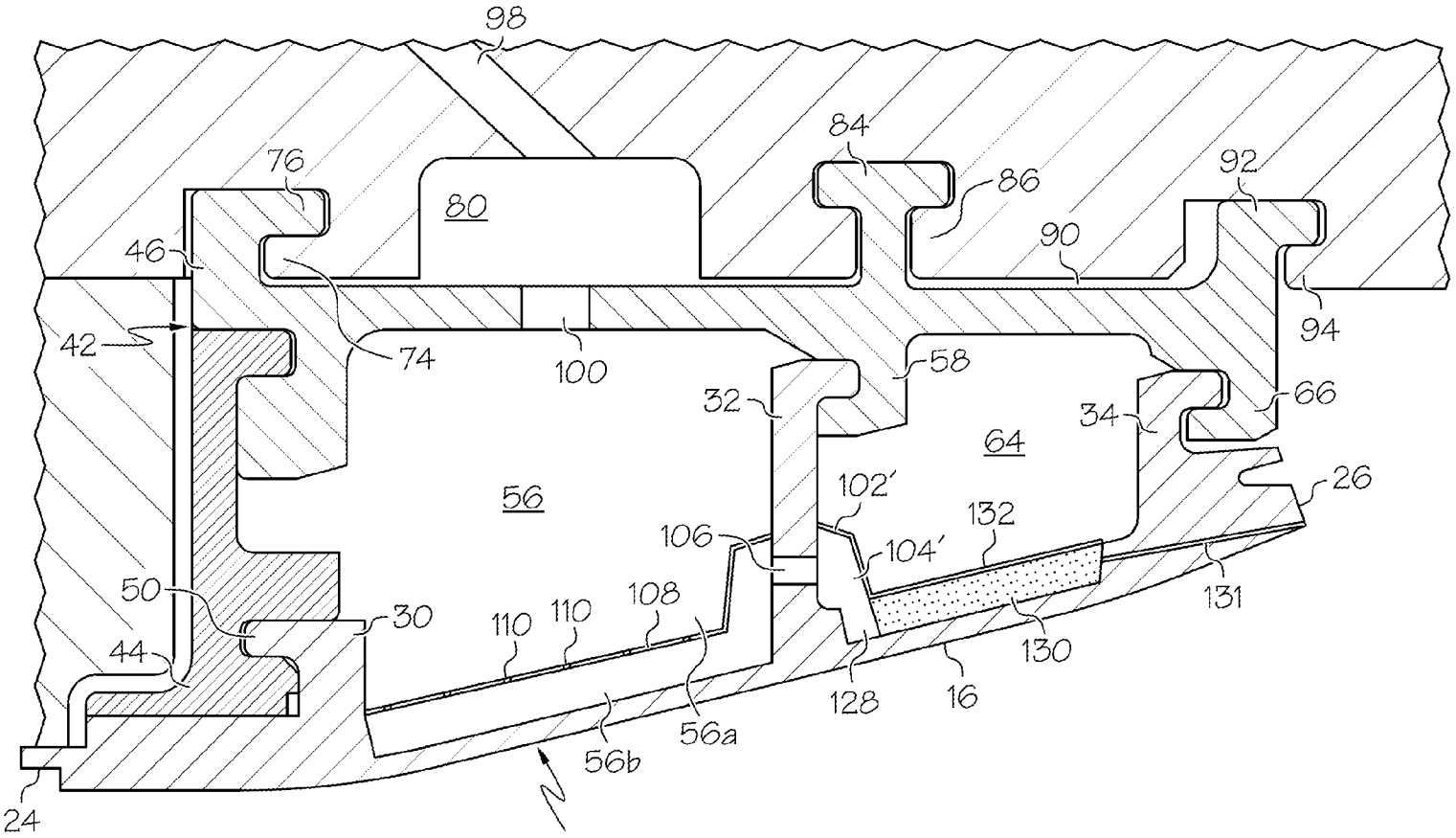
FIG. 4 is a cross sectional view of the turbine shroud assembly illustrating an alternative convective cooling system for the ring segment.

Referring to FIG. 4, an aspect of the invention is illustrated providing an alternative convection cooling circuit for the ring segment panel 14. The radially outer side of the ring segment panel 14 is formed with a forward circumferentially extending air feed trough 128 defined as a radially inner portion of the isolation chamber 104'. The panel further includes a plurality of parallel axially extending channels 130 having forward ends adjacent to and receiving cooling air from the feed trough 128. The radially outer side of the channels 130 may be separated from the aft low pressure plenum 64 by a solid plate 132 that may be a continuation of the isolation plate 102'. Alternatively, the channels 130 may comprise cast-in passages formed in the ring segment panel 14 adjacent to the inner side 16 of the panel 14. Cooling air passing through the channels 130 may exit the panel through exit passages 131 extending to the trailing edge 26. Hence, air entering the isolation chamber 64 through the crossover passages 106 may enter the channels 130 by passing directly into the trough 128 for effecting convection cooling along axial locations closely adjacent to the inner side 16 of the panel 14.

Figure 4A:
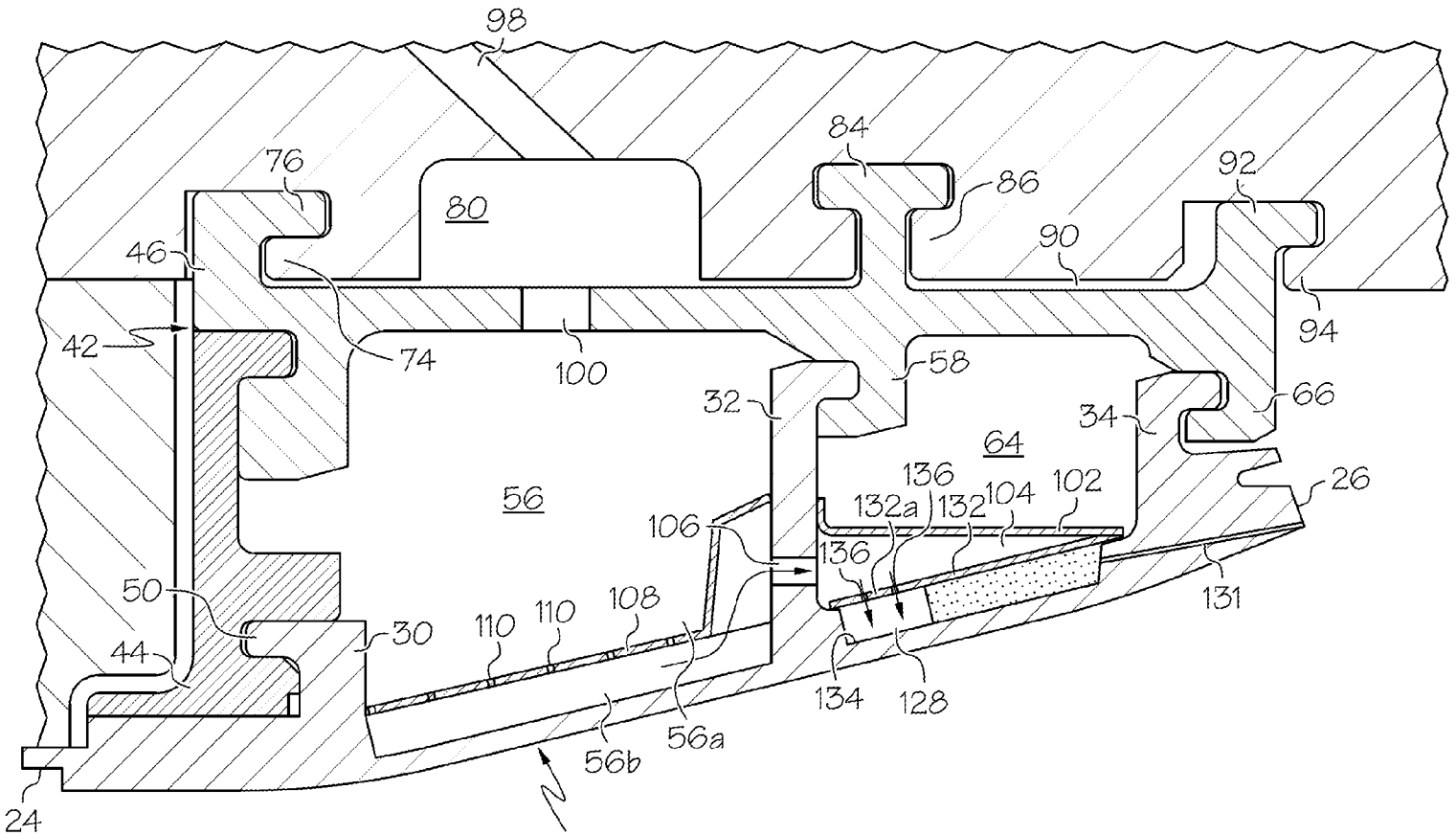
FIG. 4A is a cross sectional view illustrating an alternative convective cooling system to that shown in FIG. 4.

FIG. 4*a* illustrates an alternative configuration of the cooling circuit of FIG. 4 in which impingement cooling is provided to an inner surface 134 of the air feed trough 128. In particular, the plate 132 is formed as a separate element from the isolation plate 102, having a solid section extending over the channels 130 and including an extension portion 132*a* that is extended forwardly over the trough 128. The extension portion 132*a* intersects the midsection mounting hook 32 at a location radially inward from the crossover passages 106 and includes impingement cooling holes 136 providing impingement convection cooling of the inner surface 134 of the trough 128 before entering the channels 130 for convection cooling of the panel 14.

Figure 5:
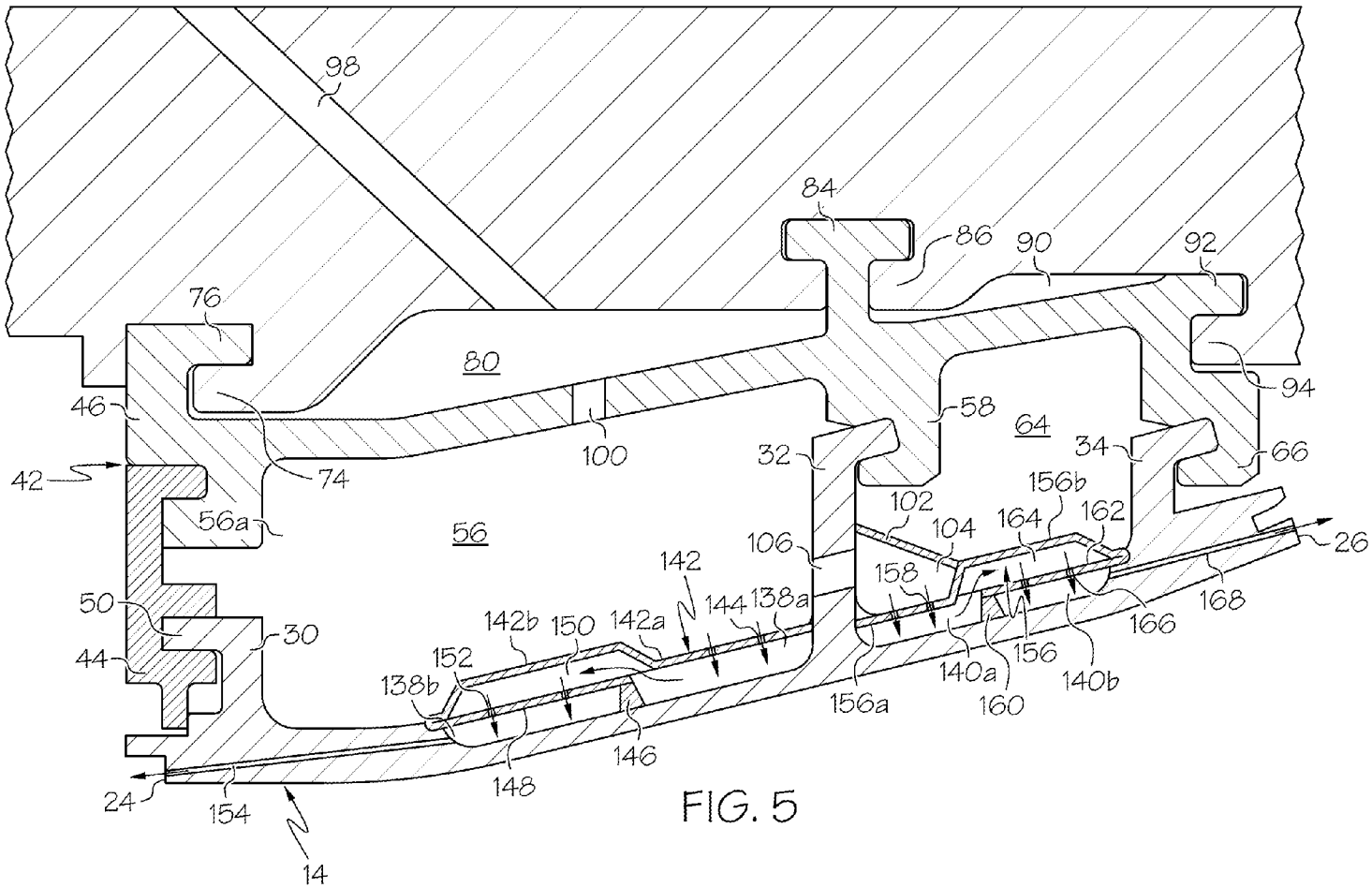
FIG. 5 is a cross sectional view of the turbine shroud assembly illustrating a further alternative convective cooling system for the ring segment.

Referring to FIG. 5, a further aspect of the invention is illustrated providing an alternative convection cooling circuit for the ring segment panel 14 comprising double impingement cooling forward and aft of the midsection mounting hook 32. In accordance with this aspect of the invention, first and second forward impingement convection cooling zones or chambers 138*a*, 138*b* are located on the radially outer side of the ring segment panel 14 forward of the midsection mounting hook 32, and first and second aft impingement convection cooling zones or chambers 140*a*, 140*b* are located on the radially outer side of the ring segment panel 14 aft of the midsection mounting hook 32.

The first forward cooling chamber 138*a* is defined between a first section 142*a* of a forward plate 142 and the outer side of the panel 14. The first section 142*a* includes a plurality of impingement cooling holes 144 permitting air to pass from the forward impingement cooling chamber supply side 56*a* to the first forward cooling chamber 138*a* for impingement cooling of the panel 14. A partition 146 extends radially and circumferentially between the first and second forward cooling chambers 138*a*, 138*b*, and a secondary plate 148 extends forwardly from a radially outer edge of the partition 146 to form a radially outer side of the second forward cooling chamber 138*b*. A secondary supply chamber 150 is formed radially outward from the second forward cooling chamber 138*b*, between the secondary plate 148 and a second section 142*b* of the forward plate 142.

Cooling air passing into the first forward chamber 138*a* provides impingement cooling to a portion of the panel 14 and passes over the partition 146 into the secondary supply chamber 150. The secondary plate 148 includes impingement cooling holes 152 permitting the air in the secondary supply chamber 150 to pass into the second forward cooling chamber 138*b* where it performs impingement cooling on a further portion of the panel 14. The air in the second forward cooling chamber 138*b* may then pass into a plurality of exit passages 154 and exit from the ring segment 20 through the leading edge 24.

The isolation chamber 104 is defined between the isolation plate 102 and a first section 156*a* of an aft plate 156, and high pressure air is provided to the isolation chamber 104 through the crossover passages 106 from the supply side 56*a* of the forward impingement cooling chamber 56. The first aft cooling chamber 140*a* is defined between the first section 156*a* of the aft plate 156 and the outer side of the panel 14. The first section 156*a* includes a plurality of impingement cooling holes 158 permitting air to pass from the isolation chamber 104 to the first aft cooling chamber 140*a* for impingement cooling of the panel 14. A partition 160 extends radially and circumferentially between the first and second aft cooling chambers 140*a*, 140*b*, and a secondary plate 162 extends aft from a radially outer edge of the partition 160 to form a radially outer side of the second aft cooling chamber 140*b*. A secondary supply chamber 164 is formed radially outward from the second aft cooling chamber 140*b*, between the secondary plate 162 and a second section 156*b* of the aft plate 156.

Cooling air passing into the first aft chamber 140*a* provides impingement cooling to a portion of the panel 14 and passes over the partition 160 into the secondary supply chamber 164. The secondary plate 162 includes impingement cooling holes 166 permitting the air in the secondary supply chamber 164 to pass into the second aft cooling chamber 140*b* where it performs impingement cooling on a further portion of the panel 14. The air in the second aft cooling chamber 140*b* may then pass into a plurality of exit passages 168 and exit from the ring segment 20 through the trailing edge 26.

Hence, the convection cooling system of FIG. 5, provides primary and secondary cooling zones, i.e., the pairs of forward and aft cooling chambers 138*a*, 138*b* and 140*a*, 140*b*, wherein the configuration of the respective forward and aft primary and secondary cooling zones form two-step serial cooling paths extending forward and aft of said midsection mounting hook 32.

It may be understood that in the configuration illustrated in FIG. 5, the isolation plate 102 and the second section 156*b* of the aft plate substantially isolate the aft low pressure plenum 64 from high pressure air and facilitate a reduction of leakage air from the ring segment, as is described above with reference to FIG. 1.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A turbine shroud assembly for a gas turbine engine, said turbine shroud assembly comprising:

a ring segment including a ring segment panel comprising a leading edge, a trailing edge and a midsection defined therebetween, said ring segment comprising a forward mounting hook at said leading edge, a midsection mounting hook at said midsection and an aft mounting hook at said trailing edge;

a ring segment carrier circumferentially spanning and supporting said ring segment, said ring segment carrier comprising a forward section, a midsection and an aft section, said forward section forming a forward hanger coupled to said forward mounting hook, said midsection forming a midsection hanger coupled to said midsection mounting hook defining a first leakage path, said aft section forming an aft hanger coupled to said aft mounting hook defining a second leakage path;

a forward impingement cooling chamber defined between said ring segment panel and said ring segment carrier and between said forward mounting hook and said midsection mounting hook;

at least one feed hole extending through said ring segment carrier and configured to meter high pressure cooling air into said forward impingement cooling chamber;

an aft low pressure chamber defined between said ring segment panel and said ring segment carrier and between said midsection hanger and said aft mounting hook, said ring segment carrier substantially preventing cooling air from entering said aft low pressure chamber;

an isolation plate extending between said midsection mounting hook and an aft location adjacent to said ring segment panel defining an isolation chamber radially inward from said aft low pressure chamber between said isolation plate and said ring segment panel; and a transverse crossover passage formed through said midsection mounting hook providing cooling air from said forward impingement cooling chamber to said isolation chamber, said isolation plate substantially preventing cooling air provided to said isolation chamber from entering said aft low pressure chamber.

2. The turbine shroud assembly of claim 1, including a forward impingement cooling plate extending between said midsection mounting hook and a forward location in said forward impingement cooling chamber, said forward impingement cooling plate including impingement cooling holes and separating said forward impingement cooling chamber into a radially outer cooling chamber supply side and a radially inner impingement cooling side.

3. The turbine shroud assembly of claim 2, wherein cooling air within said supply side of said forward impingement cooling chamber passes through said first leakage path to said low pressure aft chamber, and cooling air within said low pressure aft chamber passes out of said turbine shroud assembly through said second leakage path.

4. The turbine shroud assembly of claim 1, wherein cooling air provided to said isolation chamber is directed into contact with said ring segment panel providing convective cooling to said ring segment panel from a location adjacent said midsection mounting hook to a location adjacent said aft mounting hook.

5. The turbine shroud assembly of claim 1, wherein said isolation plate is sealed to said ring segment panel along axially extending sides of said ring segment panel between said midsection mounting hook and said aft mounting hook.

6. The turbine shroud assembly of claim 1, wherein said transverse crossover passage is located radially inward from a junction of said isolation plate with said midsection mounting hook for effecting transfer of cooling air from said forward impingement cooling chamber to said isolation chamber.

7. The turbine shroud assembly of claim 1, including an aft impingement cooling plate located radially inward from said transverse crossover passage between said isolation plate and said ring segment panel and extending between said midsection mounting hook and an aft location adjacent to said panel, said aft impingement cooling plate including impingement cooling holes providing impingement cooling from said isolation chamber to at least a portion of an outwardly facing surface of said panel.

8. The turbine shroud assembly of claim 7, including a forward impingement cooling plate extending between said midsection mounting hook and a forward location in said forward impingement cooling chamber, said forward and aft impingement cooling plates comprise primary zone cooling plates providing impingement cooling to primary zones of said panel, and including forward and aft secondary impingement cooling plates providing impingement cooling to secondary zones of said panel, wherein respective forward and aft primary and secondary cooling plates form two-step serial cooling paths extending forward and aft of said midsection mounting hook.

9. The turbine shroud assembly of claim 1, including a plurality of axial flow convection cooling channels formed in an outer side of said ring segment panel and having inlet ends adjacent to said midsection hanger hook, said inlet ends receiving cooling air from said isolation chamber.

10. The turbine shroud assembly of claim 1, including one or more axial convective cooling passages extending within said ring segment panel adjacent to axial edges of said panel, each said axial convective cooling passage including an inlet receiving cooling air from said aft low pressure chamber.

11. The turbine shroud assembly of claim 10, including a plurality of convective cooling passages in said panel extending from said forward impingement cooling chamber to said axial edges of said panel, said convective cooling passages located between said midsection mounting hook and said leading edge of said panel.

12. The turbine shroud assembly of claim 1, wherein:

said forward, midsection and aft sections of said ring segment carrier include respective forward, midsection and aft support structure engaged with cooperating structure of a casing for the engine;

a forward high pressure plenum is defined between said forward and midsection support structures for providing said high pressure cooling air through said at least one feed hole; and an aft low pressure plenum is defined between said midsection and said aft support structures and is substantially isolated from said high pressure cooling air of said forward high pressure plenum.

13. A turbine shroud assembly for a gas turbine engine, said turbine shroud assembly comprising:

a ring segment including a ring segment panel comprising a leading edge, a trailing edge and a midsection defined therebetween, said ring segment comprising a forward mounting hook at said leading edge, a midsection mounting hook at said midsection and an aft mounting hook at said trailing edge;

a ring segment carrier circumferentially spanning and supporting said ring segment, said ring segment carrier comprising a forward section, a midsection and an aft section, said forward section forming a forward hanger coupled to said forward mounting hook, said midsection forming a midsection hanger coupled to said midsection mounting hook defining a first leakage path, said aft section forming an aft hanger coupled to said aft mounting hook defining a second leakage path;

said forward section of said ring segment carrier including a forward support structure engaged with a forward cooperating structure of a casing of the engine, said midsection of said ring segment carrier including a midsection support structure engaged with a midsection cooperating structure of said casing, and said aft section of said ring segment carrier including an aft support structure engaged with an aft cooperating structure of said casing;

a forward high pressure plenum defined between said forward support structure and said midsection support structure for providing high pressure cooling air to a forward impingement cooling chamber defined between said ring segment panel and said ring segment carrier and between said forward mounting hook and said midsection mounting hook;

an aft low pressure plenum defined between said midsection support structure and said aft support structure and substantially isolated from said high pressure cooling air of said forward high pressure plenum;

an aft low pressure chamber defined between said ring segment panel and said ring segment carrier and between said midsection hanger and said aft mounting hook;

an isolation chamber defined radially inward from said aft low pressure chamber between said midsection mounting hook and said aft mounting hook;

a transverse crossover passage connecting said forward impingement cooling chamber to said isolation chamber; and said isolation chamber substantially isolating said aft low pressure chamber from cooling air provided through said transverse crossover passage to effect a reduction of leakage air through said second leakage path.

14. The turbine shroud assembly of claim 13, wherein a leakage of cooling air passes from said forward impingement cooling chamber to said aft low pressure chamber through said first leakage path, and including one or more flow passages extending from said aft low pressure chamber to a location of lower pressure in fluid communication with a hot gas path through the engine for reducing the pressure in said aft low pressure plenum and further effecting a reduction of leakage air through said second leakage path.

15. The turbine shroud assembly of claim 13, wherein:

said engagement between said aft support structure and said aft cooperating structure of said casing defines a third leakage path of cooling air out of said turbine shroud assembly; and said engagement between said midsection support structure and said midsection cooperating surface defines a fourth leakage path of cooling air from said forward high pressure plenum to said aft low pressure plenum.

16. The turbine shroud assembly of claim 13, wherein air entering said aft low pressure chamber comprises substantially only leakage air.

17. The turbine shroud assembly of claim 16, wherein air within said aft low pressure chamber comprises a cooling air source for convective cooling passages extending within said ring segment panel.

18. The turbine shroud assembly of claim 17, wherein said convective cooling passages extend axially within said ring segment panel to said trailing edge of said ring segment panel.

19. The turbine shroud assembly of claim 16, wherein air entering said aft low pressure plenum comprises substantially only leakage air.

* * * * *